United States Patent [19]

Beard

[11] 4,450,984

[45] May 29, 1984

[54] VISCOUS FLOW TILT VALVE FOR PRESSURIZED CONTAINER

[76] Inventor: Walter C. Beard, South St., Middlebury, Conn. 06762

[21] Appl. No.: 405,696

[22] Filed: Aug. 5, 1982

[51] Int. Cl.[3] ..... B65D 83/14

[52] U.S. Cl. ..... 222/402.22; 222/402.21

[58] Field of Search ..... 222/83.5, 88, 153, 402.1, 222/402.21, 402.22, 518

[56] References Cited

U.S. PATENT DOCUMENTS

| | | | |
|---|---|---|---|
| 2,487,434 | 11/1949 | Geiss et al. | 222/394 |
| 2,660,132 | 11/1953 | Pyenson . | |
| 2,667,991 | 2/1954 | Boyer . | |
| 2,709,111 | 5/1955 | Green . | |
| 2,729,368 | 1/1956 | Lapin et al. . | |
| 2,731,298 | 1/1956 | Green . | |
| 2,739,841 | 3/1956 | Soffer . | |
| 2,744,665 | 5/1956 | Carlson et al. | 222/518 X |
| 2,778,434 | 1/1957 | Hastert et al. | 222/5 X |
| 2,953,284 | 9/1960 | Prussin et al. . | |
| 3,060,965 | 10/1962 | Taggart . | |
| 3,096,003 | 7/1963 | Nesin | 222/518 X |
| 3,216,463 | 11/1965 | Kibbel, Jr. et al. . | |
| 3,255,936 | 6/1966 | Healy et al. . | |
| 3,348,743 | 10/1967 | Green | 222/402.24 |
| 3,506,241 | 4/1970 | Ewald | 222/402.21 X |
| 3,547,405 | 12/1970 | Ewald . | |
| 3,581,941 | 6/1971 | Bruce et al. . | |
| 3,635,379 | 1/1972 | Angele . | |
| 3,830,760 | 8/1974 | Brown et al. . | |
| 4,171,757 | 10/1979 | Diamond . | |

FOREIGN PATENT DOCUMENTS

| | | | |
|---|---|---|---|
| 569457 | 11/1957 | Italy | 222/518 |
| 1358729 | 7/1974 | United Kingdom | 222/402.21 |

OTHER PUBLICATIONS

Three Pages, Unnumbered and Undated from a Catalogue Issued by Clayton Corp., 4205 Forrest Park Blvd., St. Louis, MO 63108.

Reprint of Article by Walter C. Beard from Aerosol Age Apr., May 1966, Entitled "Aerosol Valves Up-to--Date".

Reprint of Article by Walter C. Beard from Aerosol Age Entitled "The Beard Universal Seal-Tip Valve" Apr., 1972.

*Primary Examiner*—Joseph J. Rolla
*Assistant Examiner*—Thomas C. Fitzgerald
*Attorney, Agent, or Firm*—Hill, Van Santen, Steadman & Simpson

[57] ABSTRACT

A stem tiltable valve structure for aerosol containers and the like wherein a moveable cup member is provided which is actuated by stem tilting and which when so actuated undergoes reciprocal sliding movements in the valve structure. In the closed position, a positive sealing action is achieved between the moveable cup member and a gasket. The valve structure is well adapted for the dispensing of a highly viscous liquid.

24 Claims, 23 Drawing Figures

21
20
34
28
23
24
35
25
37
36

44
60
43
21
46
40
42
52
41
47
26
31
33
27
22
45
57
51
38
53
48
56
20
29
59
50
55
58

29
46
47
44

43
45
57
52
48
53
55

91
21c
97
96
38c
92
96
95
94

21c
43c
95
93
91
97
94
96
38c
98
92
97
XII
XII
58c 44
60
43

29
38
45
47
61
52
51
58
53
59
48
55
56

21a
43a
67
65
66
47a
63
62
29a
68
45a
71
72
VI
VI
38a
58a
74
73
29a
20a
76
64

VISCOUS FLOW TILT VALVE FOR PRESSURIZED CONTAINER

BACKGROUND OF THE INVENTION

1. Field of the Invention

This invention lies in the field of tiltable valves for pressurized containers, especially valves adapted to the dispense viscous fluids, and also to improved moveable cup members for such valves.

2. Description of the Prior Art

In the art of aerosol valves, it has heretofore been appreciated that tiltable valve assemblies can employ among their components a moveable cup member (see, for example, Ewald U.S. Pat. No. 3,547,405). Characteristically, in such prior art aerosol valve assemblies, such a moveable cup member has served as a means for introducing turbulent type flow into the fluid stream being dispensed which is desirable in order to produce a homogenous aerosol comprised of material being dispensed in admixture with the pressurizing propellant in a vapor phase.

When, however, it is desired to dispense a highly viscous fluid, a completely different type of fluid flow through such a valve structure during dispensing is desired and is even necessary for operability reasons. For a viscous liquid, fluid flow through such a valve structure should be laminar in type and not turbulent.

In turbulent flow, it is typical in the art to utilize small clearance passages particularly in the region of the moveable cup member which then feed into a relatively larger passageway out of which the aerosol is finally vented. When a tiltable valve structure containing such small passageways in the region of the moveable cup is used for an attempt to dispense a viscous fluids, it is discovered that severe problems exist owing to the difficulty of passing a viscous liquid through such narrow passageways. As a practical matter, it is found that narrow passageways in the region of the moveable cup member produce a generally inoperative valve structure for the dispensing of highly viscous fluids.

In order to provide a valve assembly for use with an aerosol type dispensing container from which a viscous liquid is to be dispensed, it is desirable, then, to have cross-sectionally very large and longitudinally very short passageways through which such a viscous liquid must pass to be dispensed.

The achievement of a tiltable valve assembly with extremely large passageways particularly in the region of the moveable cup member combined with the necessity to have a positive valve sealing action when the valve structure is in a closed configuration represents a problem in the prior art which so far as is now known has not been previously solved.

BRIEF SUMMARY OF THE INVENTION

This invention is directed to a new and improved tiltable valve assembly adapted for the dispensing of highly viscous fluids from pressurized containers. Such valve assembly can be manufactured in an assembled configuration, subsequently stored, and then assembled as a unit onto a desired pressurizable container without further valve assembly modification.

The present invention is also directed to a tiltable valve assembly incorporating a new and improved type of moveable cup member which is characterized by the feature that a maximum flow capability for highly viscous fluids therethrough is achievable and also by the feature that a positive sealing action is obtainable between the moveable cup member and a gasket means in the valve assembly when the valve assembly is in a closed configuration.

The present invention is further directed to an improved dispensing device for dispensing highly viscous fluids which utilizes in combination a pressurizable container and a tiltable valve assembly of the type here provided.

More specifically, the present invention concerns an improved tiltable valve assembly Such an assembly includes a mounting cup member sealingly securable to a pressurized container and having communication with the pressurized contents of said container. Carried within said mounting cup member, is a resilient seal member. An elongated tubular nozzle means having a dispensing orifice in one end thereof and having a second end extending through said mounting cup member is provided which is supported in said mounting cup member by such resilient seal member in a normally generally straight upright extended position.

A moveable valve cup member is reciprocally slidably carried within said mounting cup member and is normally biased against said resilient seal member to form a seal means for normally sealing the contents of an associated container. Such moveable valve cup member is engageable with such second end of such tubular nozzle means and the contents of such pressurized container are dispensable when the one end of such tubular nozzle means is tiltably displaced relative to its generally straight upright extended position by an external deflecting operating force applied thereagainst, thereby opening such seal means. The moveable valve cup member includes a base portion extending across said second end of said tubular nozzle means, rib means upstanding from said base portion for engaging said resilient seal member peripherally of said tubular nozzle means, and guidance means for orienting said moveable valve cup member relative to said mounting cup member for stable reciprocal sliding movements longitudinally relative to said mounting cup member. Channel means are also defined in said moveable valve cup member longitudinally extending therethrough for the laminar flow of a viscous fluid therethrough.

The interrelationship between said moveable valve cup member, said tubular nozzle means, said resilient seal member, and said mounting cup member is such that a substantially unobstructed flow of said contents through said valve structure can occur when said one end is so tiltably displaced.

Various other advantages, features, objects, aims, purposes, and the like will be apparent to those skilled in the art from the accompanying specification and drawings.

DETAILED DESCRIPTION

Figure 1:
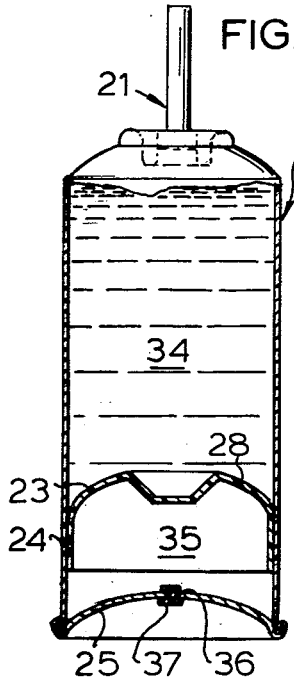
FIG. 1 is a vertical sectional view through one embodiment of a container fitted with one embodiment of a valve structure of the present invention, some parts thereof shown in elevation.

Referring to FIGS. 1–4, a dispensing container or can 20 is fitted on its top end with a tilt valve structure 21 of the present invention. Container 20 is provided with an axially located aperture 27 having a rolled perimeter 22, container 20 being formed in this instance of sheet metal.

Container 20 is provided with an interiorally located axially slidably reciprocal piston 23 which is provided with a dome portion 28 and a peripheral skirt portion 24 adapted to make a sealing engagement between the skirt and the interior sidewall portions of the container 20. The piston 23 is conveniently formed of a resilient plastic or the like.

The piston 23 is conveniently inserted into the container 20 before a domed bottom cap 25 formed of metal or the like is press formed onto the bottom end of the container 20.

The tilt valve structure 21 includes a metallic mounting cup 29 which terminates in a rolled perimeter 31 that is adapted to make nesting engagement with the rolled perimeter 22. Interior surfaces of the roll 31 are provided with a coating 26 formed of a sealing material of resilient, elastomeric plastic composition, such a chloropene rubber composition, or the like, so that when the mounting cup 29 is fitted over the roll 22 and formed by collet fingers, there is produced a retaining crimp 33 in cup 29, and the preformed valve structure 21 is thus sealingly associated with the container 20.

With the valve structure 21 thus mounted to the container 20, the interior of the container 20 defines a first separate chamber 34 in combination with the adjoining portion of the valve structure 21, the walls of the container 20, and the dome portion 28 of the piston 23, while a separate second chamber 35 is defined between the container 20, the bottom cap 25, and the piston 23. Access to the interior of the second chamber 35 is obtained through the bottom cup 25 which is provided with a centrally disposed aperture 36 which is sealinglv closable by a plug 37 formed of a resilient elastomeric plastic material, such as a nitrile rubber or the like. The first chamber 34 is filled in a conventional manner with a viscous fluid material or the like which is here preferably a viscous liquid which is to be dispensed through the valve structure 21. Thereafter, the second chamber 35 is charqed in a conventional manner with a pressurizing substance after which the plug 37 is inserted into the aperture 36. As those skilled in the art appreciate, as a material that has been charged into the first chamber 34 is dispensed through the valve structure 21, a relatively constant pressure may be maintainable, if desired, in the second chamber 35 by using as the pressurizing substance a material which is low boiling at ambient temperatures and which has a constant vapor pressure at such temperatures. As material is dispensed from the first chamber 34, the volume of the first chamber diminishes while the volume of the second chamber 35 correspondingly enlarges. By regulating the quantity of pressurizing substance initially charged into the second chamber 35, the gas pressure maintained in the interior of the second chamber 35 can remain relatively constant as the volume of the first chamber diminishes during dispensing of material from the first chamber 34.

While the valve structure 21 is particularly well suited for the dispensing of a viscous fluid from a chamber 34, as described, the valve structure 21, as those skilled in the art will readily appreciate, is also suitable for the dispensing of a viscous fluid which has admixed therewith a gaseous propellant in an appropriate pressurized chamber or container where the propellant can be, for example, a member of the well-known low molecular weight fluorocarbon family. Valve structure 21 can thus be used, if desired, for dispensing aerosols and gaseous fills generally.

In the type of aerosol container 20 illustrated in FIG. 1, one advantage is that the fill being dispensed is maintained in a separate environment from the environment occupied by the pressurizing substance. In this way, a fluid being dispensed is free from entrained pressurizing gas bubbles or the like which can sometimes be an important consideration when the material being dispensed is desired to be in a liquid or semisolid condition as discharged from valve structure 21 as opposed to being in the form of a foaming fluid or a gaseous material as is common to many aerosols. Examples of viscous liquid or semisolid fills which one can dispense from a container with valve assembly as shown in FIG. 1 include, for example, sealants, greases, cheeses, food toppings, syrups, toothpaste, whipped creams, including shaving creams, dermal (e.g. hand or face) creams, and the like.

As those skilled in the art will appreciate, the internal diameter of the aperture 27 defined by the rolled perimeter 22 is typically standardized in the valve trade while the conventional mounting cup 29 is so formed as to have an inner wall member 38 defined therein which can have a diameter and an axial length as particularly chosen for an individual type of valve structure desired.

Figure 2:
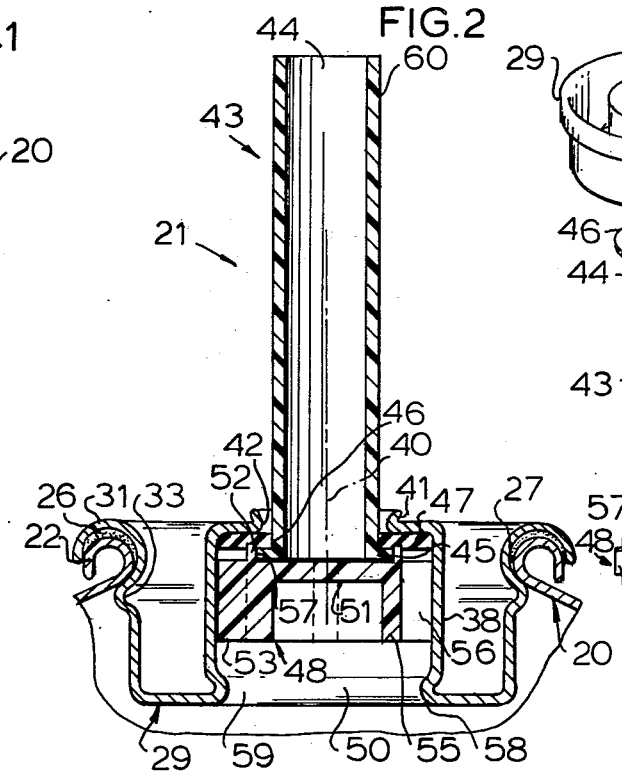
FIG. 2 is an enlarged fragmentary vertical sectional view along the axis of the valve structure shown in FIG. 1.
Figure 3:
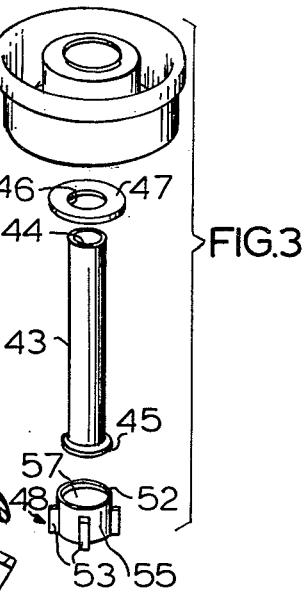
FIG. 3 is an exploded view of the valve components employed in the embodiment illustrated in FIG. 2.

Through the center portion and along the axis 40 of the mounting cup 29 is an aperture 42 which can be optionally provided, as in assembly 21, with an upstanding lip 41 which serves as a stiffening or reinforcing means about an aperture 42. Through the aperture 42 is extended a nozzle stem member 43 which, at its upper end portion, is provided with a dispensing orifice 44 and which, at its opposite end portion, is provided with a radially outwardly extending flange 45 that is here integrally formed with the nozzle stem member 43. The nozzle stem member 43 extends also through a central aperture 46 of a resilient elastomeric gasket 47 which gasket 47 also makes abutting contact with both adjacent outer wall portions of the nozzle stem member 43 and the flange 45. The outer perimeter of gasket 47 is seated in the center portion of the mounting cup 29. The nozzle stem 43 is in a normally upright configuration as is illustrated in FIG. 2.

A moveable cup member 48 is disposed for axial sliding movements in the region of the central portion of mounting cup 29. The moveable cup member 48 includes a valve plate 51 which transversely (relative to nozzle stem member 43) extends across flange 45 and further includes adjacent the outer periphery of valve plate 51 an integrally formed associated upstanding rib portion 52 which annularly extends valve plate 51. The rib portion 52 when the valve structure 21 is in its closed configuration as shown in FIG. 2 makes a seating engagement with adjacent portions of the gasket 47.

Also, integrally associated with the valve plate 51 are a plurality of radially (relative to plate 51) outwardly extending guide ribs 53 which are configured so as to be equally sized and in a spaced, adjacent, or even optionally contacting, slidable relationship with respect to adjacent wall portions of wall 38. The individual guide ribs 53 are in circumferentially preferably equally spaced relationship to one another In the embodiment shown, the guide ribs 53 extend axially downwardly away from the valve plate 51 relative to wall 38 to an extent sufficient to stabilize slidable movements of the moveable cup member 48 relative to the mounting cup 29 and prevent cocking of valve plate 51.

A rearwardly (relative to gasket 47 and nozzle stem member 43) or downwardly axially extending apron 55 integrally extends from valve plate 51 in radially spaced relationship to the ribs 55. The principal purpose of this apron 53 is to provide a point of attachment for the adjacent portions of individual ribs 53 thereby to provide a reinforcing means for supporting the ribs 53 in the moveable cup member 48.

Between circumferentially adjacent pairs of guide ribs 53 substantial clearance passages 56 are provided which extend radially between the adjacent sidewall portions of the walls 38 and adjacent portions of apron 55 and the valve plate 51. The relatively large openings or passageways 56 permit the passage through the valves assembly 21 of large volumes of material to be dispensed therethrough which is particularly desirable for the dispensing of highly viscous fluid material.

The moveable cup member 48 is further provided with a pocket 57 across the upper face of valve plate 51 between the rib portion 52. In this pocket the inner end portion in the region of flange 45 of nozzle stem member 43 is receivable so that such is in an adjacent but preferably noncontacting relationship with respect to the valve plate 51 In this way, the rib portion 52 can be allowed to be received into a sealing engagement with contacting adjacent portions of the gasket 47 without interference from stem member 43.

A crimped portion 58 is formed across the mouth 59 of wall 38, by collet fingers or the like in the valve assembly, so as to provide a stop means limiting extent of axial slidable movements of the moveable cup member 48 relative to wall 38. Thus, the assembly of the valve structure 21 can remain integral during storage and after assembly onto a container 20, or the like.

Figure 4:
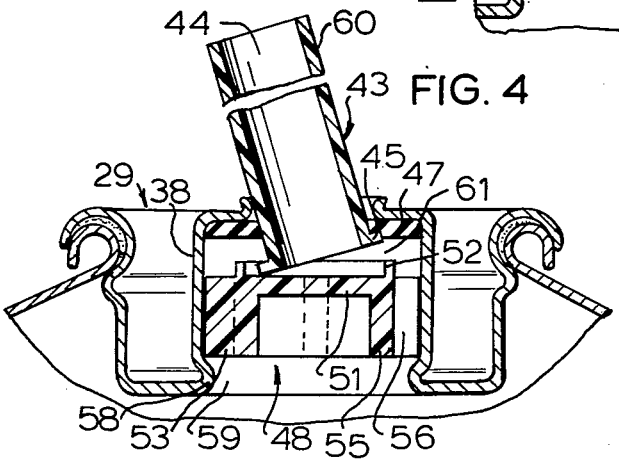
FIG. 4 is a view similar to FIG. 2, but illustrating such valve structure in an open (stem tilted) configuration.

When an external operating deflecting force is applied against the outer or tip end 60 of the nozzle stem member 43, the flange 45 is moved against the valve plate 51, thereby causing the moveable cup member 48 to slidably move towards crimped portion 58 resulting in the unseating and opening of the rib portions 52 relative to the gasket 47 thereby permitting pressurized contents in the first chamber 34 to flow upwardly and outwardly through the nozzle stem member 43 via the dispensing orifice 44. In normal operating configuration, after such an opening of the valve structure 21, there results a flow of the pressurized contents within the container in a laminar manner through the clearance passageways 56, past the open area 61 between the rib portions 52 and the gasket 47, and into and through the nozzle stem member 43, as shown in FIG. 4.

When valve closure is desired, the tip end 60 is allowed to return to its normally upright configuration which effectuates a resealing between the rib portions 52 and the gasket 47. The resealing is effectuated in the embodiment shown by the interior pressure exerted upon the underside of the moveable cup member 48 from the fill contents in the chamber 34.

Figure 5:
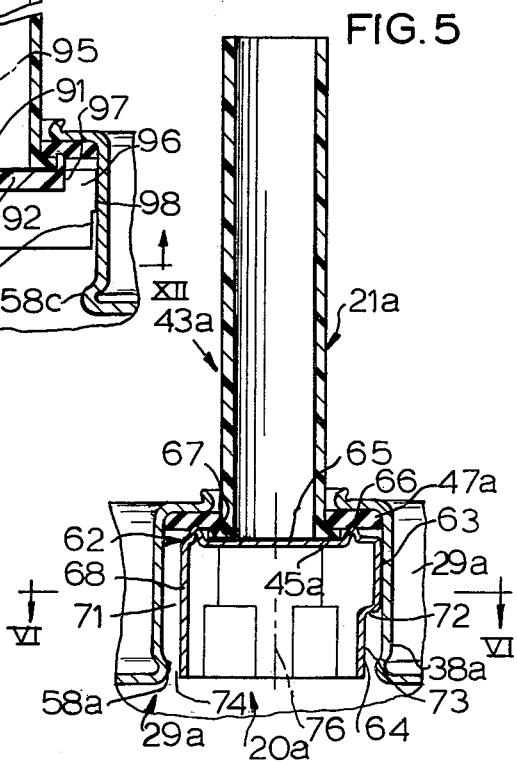
FIG. 5 is a view similar to FIG. 2, but showing an alternative embodiment of a valve structure of the present invention.
Figure 6:
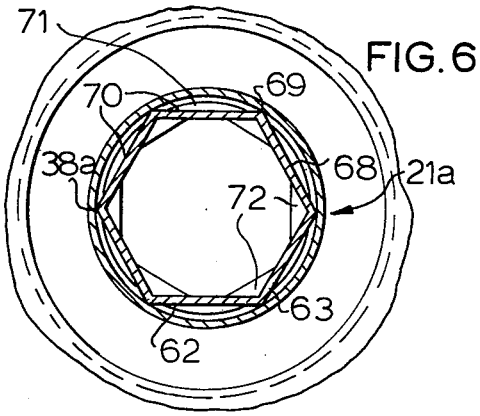
FIG. 6 is a transverse sectional view taken along the line VI—VI of FIG. 5.

Referring to FIGS. 5 and 6, there is seen an alternative embodiment of the valve structure 21, the alternative valve structure embodiment in FIGS. 5 and 6 being designated in its entirety by the designation **21*a*. Components of the valve structure 21*a* which are similar in configuration and function to corresponding components in valve structure 21 are similarly numbered but with the addition of the letter "a" thereto for convenience. In valve structure 21*a*, the moveable cup member 62 is here formed of a conformable sheet material, such as sheet metal or the like. As those skilled in the art will appreciate, the moveable cup member 48 can be formed of molded plastic, molded metal, or the like, as desired. The moveable cup member 62 is characterized by having an upper portion 63 which is adjacent the valve stem member 43*a* and by having a rear portion 64 which is adjacent the interior of the vessel 20*a*. The upper portion 63 includes a valve plate 65 which has a peripheral upstanding rib portion 66 that is adapted to make seating contact with gasket 47*a*, a pocket 67 being formed by the valve plate 65 with rib portions 66 for receipt of the base and flange 45***a* of the stem 43*a*. The cross-sectional configuration of the sidewalls 68 of the upper portion 63 are hexagonally configured, as shown, for example, in FIG. 6. In this hexagonal configuration, the peaks define rib portions 69 which are adapted to make sliding engagement with wall portions 38*a* for guidance of the moveable cup member 62. The flattened wall portions 70 between adjacent rib portions 69 define in relation to the radially spaced wall portions 38*a* passageways 71 for the movement of fluid being dispensed through the valve member 21*a*. Thus, the passageways 71 are comparable to the passageways 56 in the moveable cup member 48.

The lower sidewall portion 73 of the rear portion 64 are set back by a step portion 72 so as to provide a clearance passageway 74 between the lower sidewall portions 73 and the crimped portion 58*a*. To achieve such setback and production of clearance passageway 74, the lower sidewall portions 73 are setback towards the axis 76 of moveable cup member 62 in longitudinally adjacent relationship to each rib portion 69. The step portion 72 limits travel of moveable cup member 62 relative to crimped portion 58*a*.

Figure 8:
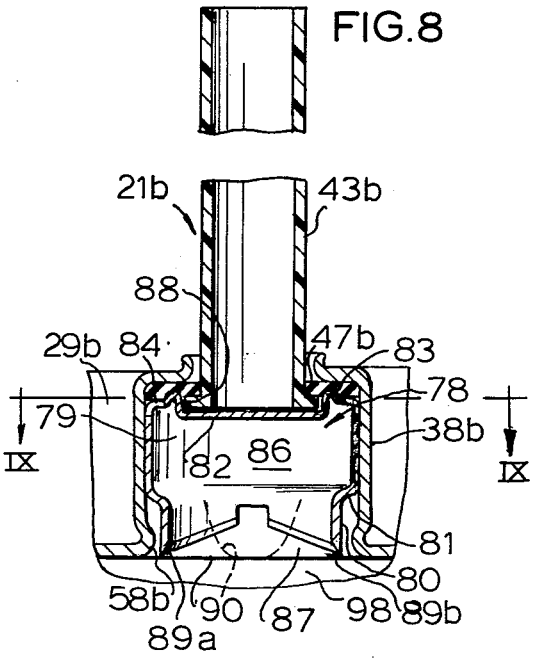
FIG. 8 is a view similar to FIG. 2, but showing a further alternative embodiment of a valve structure of the present invention.
Figure 9:
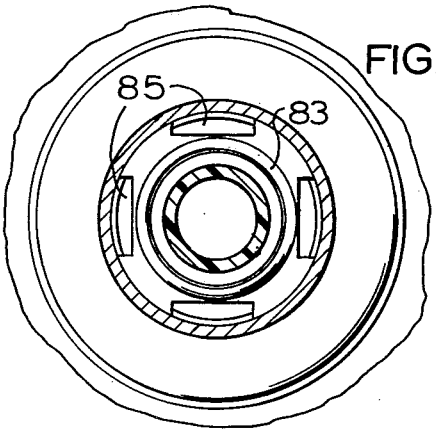
FIG. 9 is a transverse sectional view taken along the line IX—IX of FIG. 8.
Figure 10:
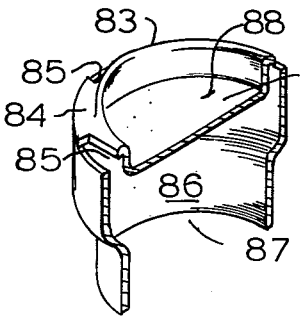
FIG. 10 is a fragmentary perspective view of an alternative embodiment of the moveable valve cup member employed in the embodiment shown in FIGS. 8 and 9.

Referring to FIGS. 8 through 10, there is seen another embodiment of a tilt valve structure, this embodiment being designated the numeral 21*b* in its entirety and having components thereof similar to those of valve structure 21 similarly numbered but with the addition of the letter "b" thereto. The tilt valve structure 21*b* utilizes a moveable cup member 78 which, like moveable cup member 62, has an upper portion 79 and a rear portion 80 (in relation to the nozzle stem member 43*b*). The moveable cup member 78 is formed of plastic or metal and the rear portion is adjoined to the upper portion by a step portion 81. Cross-sectionally, each of the upper portion 79 and of the rear portion 80, respectively, are here cross-sectionally circular. The outer diameter of the upper portion 79 is such as to permit the upper portion 79 to make reciprocal sliding engagement with adjacent wall portions 38*b* of mounting cup 29*b*. The valve plate portion 82 of moveable cup member 78 is provided with upstanding rib portions 83 adapted to engaged and sealingly seat against the gasket 47*b*. A pocket 88 is defined diametrically across the rib portions 83 in combination with the valve plate 82. The step portion 81 engages crimped portion 58*b* to limit sliding travel of moveable cup member 78 relative to mounting cup 29*b*.

A further step portion 84 is provided between rib portion 83 and the sidewalls of upper portions 79, and through the step portion 84 are provided a plurality (here four) of passageways 85. The passageways 85 are preferably equal to one another in configuration and are preferably equally circumferentially spaced from one another. In the assembled valve structure 21*b*, fluid material to be dispensed through the nozzle stem member 43*b* passes through the interior 86 of moveable cup member 78 past the entry mouth 87 thereof and out through the passageways 85 when the seat between the rib portions 83 and the gasket 47*b* is opened by reason of a tilting of the nozzle stem member 43*b* (in the same manner that nozzle stem member 43 is tilted as above described). The cross-sectional diameter of rear portion 80 is chosen so as to permit clearance between the rear portion 80 and the crimped portion 58*b*.

The moveable cup member 78, in the embodiment shown, is further provided with a pair of cutting edges 89*a* and 89*b*, respectively, on the lower end of rear portion 80. A sealing membrane 90 is secured (by an adhesive or the like, not shown) across the lower fold of the mountinq cup 29. This membrane 90 can be formed of a metal foil such as aluminum or the like. When the nozzle stem member 43*b* is initially deflected, the moveable cup member 78 is cammed downwardly so that the cutting edges 89*a* and 89*b* engage the surface of sealing membrane 90 and rupture same in regions of contact which results in a displacement of the severed folds of sealing membrane 90 relative to their initial configuration into a configuration as illustrated by the phantom lines shown in FIG. 8. Observe that the passageways 98 thus formed do not empede the flow of a viscous solid material into and through the tilt valve structure 21*b*.

As those skilled in the art will appreciate, it may be desirable in some embodiments of a tilt valve structure 21*b* to complete shear away the sealing membrane 90 which is achievable by appropriate formation of the cutting edge surfaces on the rear portion 80.

Figure 12:
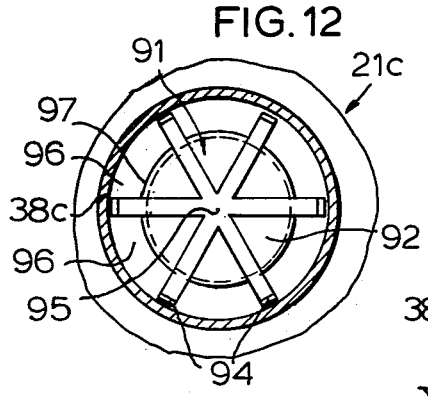
FIG. 12 is a transverse sectional view taken along the line XII—XII of FIG. 11.
Figure 11:
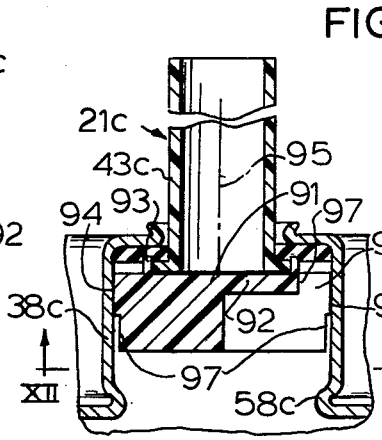
FIG. 11 is a view similar to FIG. 2, but illustrating a further embodiment of a valve structure of the present invention.

Referring to FIGS. 11 and 12, there is seen a further embodiment of a tilt valve structure of the present invention which is herein designated in its entirety by the identification 21*c*, and components thereof similar to the components employed in tilt valve structure 21 are identically numbered but with the addition of the letter "c" thereto. Tilt valve structure 21*c* utilizes a moveable cup member 91 which incorporates in an integrally formed structure a valve plate 92, a rib portion 93 and guide ribs 94 which elements can be considered to be analogous in function to valve plate 51, rib portion 52, and guide ribs 53 of moveable cup member 48 except that in the moveable cup member 91 no apron 55 is employed. Instead, in moveable cup 91, the respective guide ribs 94 join together along and adjacent to the axis 95 of moveable cup member 91 so that clearance passageways 96 are formed between circumferentially adjacent pairs of guide ribs 94 which are relatively even larger than the clearance passageways 56 provided in the moveable cup member 48. The limiting factor on the dimensions of any given clearance passageway 96 are determined practically by the cross-sectional area existing between the edge perimeter 97 of moveable cup member 91 and the adjacent wall 38*c* radially, on the one hand, the circumferential distance between a pair of circumferentially adjacent guide ribs 94, on the other hand. In the embodiment shown, the rear region 97 (relative to nozzle stem member 43) is notched so that only the upper portion 98 of each guide rib 94 is adapted to make sliding engagement with wall 38*c*.

Figure 14:
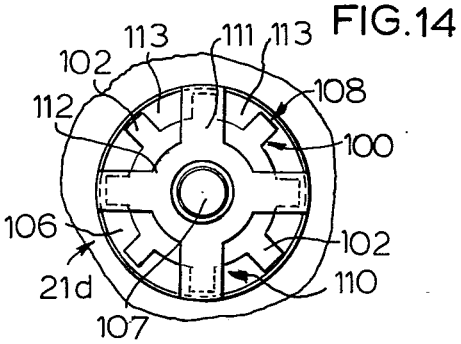
FIG. 14 is a transverse sectional view taken along the line XIV—XIV of FIG. 13.
Figure 13:
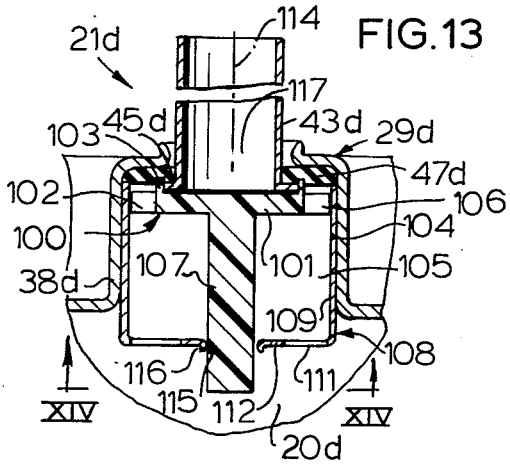
FIG. 13 is a view similar to FIG. 2, but illustrating a further alternative embodiment of a valve structure of the present invention.

Referring to FIGS. 13 and 14, there is seen another embodiment of a tilt valve structure of this invention, this embodiment being designated in its entirety by the numeral 21*d*, and the components of valve structure 21*d* which correspond to the components employed in the valve structure 21 are similarly numbered but with the addition of the letter "d" thereto. Here, a moveable cup member 100 is utilized which includes a valve plate 101 which transversely (relative to nozzle stem member 43*d*) extends across flange 45*d* and is provided adjacent to its periphery with integrally associated, radially outwardly projecting rib portions 102 annularly extending thereabout in circumferentially spaced relationship to one another. Upstanding from the periphery of valve plate 101 is a rib portion 103 which is annular in extent and configuration and which, when the valve structure 21*d* is in its closed configuration as shown in FIG. 13, makes a seating engagement with adjacent portions of the gasket 47*d*. The guide ribs 102 are configured so as to be in a spaced, adjacent relationship with respect to adjacent wall portions 104 within a central aperture or region 105 of structure 21*d*.

Between circumferentially adjacent pairs of guide ribs 102, substantial clearance passages 106 are provided which extend radially between wall portions 104 and valve plate portion 51. The relatively extremely large openings of the clearance passageways 106 permit the passage through the valve assembly 21*d* of large volumes of material to be dispensed as desired for the passage and dispensing of highly viscous fluid materials.

The moveable cup member 100 is further provided with a centrally disposed, rearwardly extending (relative to nozzle stem member 43*d*) foot 107 which is integrally associated therewith. Any convenient configuration and location can be utilized for foot 107 as those skilled in the art will appreciate.

The valve structure 21*d* is additionally provided with a bridge guide means here exemplified by a cup shaped embodiment 108 which is preferably formed of sheet metal. Sidewall portions 109 of bridge guide 108 frictionally engage adjacent sidewall portions 38*d* of mounting cup 29*d* so that bridge guide 108 is fixed in relationship to mounting cup 29*d*. Thus, the interior cross-sectionally generally circular sidewall surfaces of central region 105 are defined by the inner sidewall surfaces of sidewall portions 109. In place of a frictional engagement between the sidewall portions 109 and wall members 38*d*, one can employ any convenient conventional securing means, including adhesives, or the like, if desired.

The bottom or central portion 110 of the bridge guide 108 is configured in the form of a spider wherein legs 111 join at their outer end portions with the sidewalls portions 109 and at their inner end portions, respectively, with a central section 112 in the bottom portion 110. The open areas 113 between circumferentially adjacent pairs of legs 111 provide apertures through which the fill contents being dispensed from a pressurized container 20*d* can pass when the valve structure 21*d* is in an open (operating) configuration. The structuring of the bridge guide 108 is preferably such as to maximize the total cross-sectional area of the individual open areas 113 while still leaving the legs 111 rigid. In one presently preferred embodiment, the size of the open areas 113 such that cumulatively such open areas 113 comprise at least about 50% of the total surface area occupied by the sum of the legs 111, the central section 112, and the apertures or open areas 113.

Preferably, as in the tilt valve structure 21*d*, the foot 107 extends coaxially with the axis 114 of the valve structure 21*d*. Central portion 112 is provided with an opening 115 along axis 114 which is adapted to receive slidably therethrough the foot 107. Preferably, the periphery of opening 115 is formed with a lip 116 which serves as a stiffening and channel defining means for sliding reciprocal movements of the foot 107 relative to the opening 115.

By utilizing the combination of foot 107 and bridge guide 108, the problem of maintaining a desired transverse orientation for valve plate 101 and its associated guide ribs 102 and rib portion 103 relative to cup 29*c* is solved without employing guide rib portions which are substantially thicker than the valve plate 101 which could otherwise be needed in order to stabilize and any prevent cocking tendency for the valve plate 101 during operation of the valve structure 21*d*. For maintaining the flange 45*d* in an adjacent but noncontacting relationship to valve plate 101 when the valve structure 21*d* is in a closed configuration, a pocket 117 is formed diametrically between the rib portions 103 and the adjacent surface portions of the valve plate 101.

Figure 7:
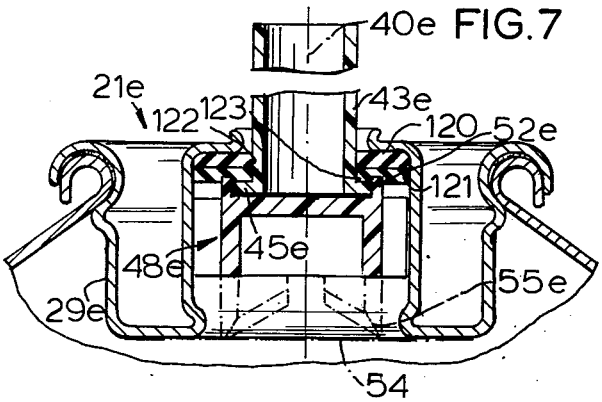
FIG. 7 is a view similar to FIG. 2, but showing a further alternative embodiment of a valve structure of the present invention.

Referring to FIG. 7, there is seen another embodiment of a tilt valve structure of this invention which is herein designated in its entirety by the numeral 21*e*. Components of valve structure 21*e* which are similar to the components in the valve structure 21 are similarly numbered but with the addition of the letter "e" thereto. In valve structure 21*e*, the gasket 47 of valve structure 21 is replaced with two gaskets 120 and 121 which are positioned in face to face engagement with one another along the axis 40*e*. The outer perimeter of each gasket 120 and 121 is seated in the center portion of the mounting cup 29*e* and the nozzle stem member 43*e* extends through the respective central apertures 122 and 123 of gaskets 120 and 121. The nozzle stem member 43*e* has a contacting relationship with the edge portions of each aperture 122 and 123 and the gasket 121 also makes abutting contact with adjacent wall portions of the flanqe 45*e*. The gasket 121 is preferably formed of a more elastic and softer and more resilient material than the corresponding material employed in gasket 120. Thus, a seating, sealing engagement between the rib portion 52*e* and gasket 121 is relatively easy to achieve while gasket 120 functions as a biasing means tending to maintain the nozzle stem member 43*e* in its normally upright (valve closed) position.

In each of the valve structures 21 through 21*e*, the internal pressure within an associated pressurized the dispensing container 20 serves to maintain a yielding bias upon the moveable cup member tending to maintain these respective valve structures in a normally closed configuration.

In all of these valve structures 21 through 21*e*, the moveable cup member is configured so as to provide a maximum cross-sectional area which is done for purposes of permitting the passage therethrough of viscous material being dispensed. In addition, the axial distance (along the valve axis) of such passageways through each moveable cup member are configured so as to be as short as possible consistent with the requirements of stable, reliable valve operation. The type of flow characteristic achieved through the moveable cup member in valve structures of this invention is such as to promote laminar flow as opposed to turbulent flow, the latter flow type being characteristic of the flow achieved with prior art valve structures, particularly the prior art valve structures wherein gases are being dispensed and wherein turbulent flow aids in the dispensing of a homogenous, uniform aerosol spray. The valve structures of the present invention are thus particularly well suited for the dispensing of highly viscous liquids or fluids.

Also, as those skilled in the art will appreciate, in an optional form of the tilt valve structure 21*e*, the bottom of the moveable cup member 48*e* is provided with an apron 55*e* (shown in phantom) which is configured so as to provide lower cutting edge (comparable to that in moveable cup member 78) while a sealing membrane 54 (such as aluminum foil or the like mounted across the bottom of the mounting cup 29 by an adhesive or the like not shown) is rupturable by the cutting edge of the moveable cup member 48*e* as the same is moved downwardly in an initial valve operating procedure involving the tilting of the nozzle stem member 43*e*.

Figure 15:
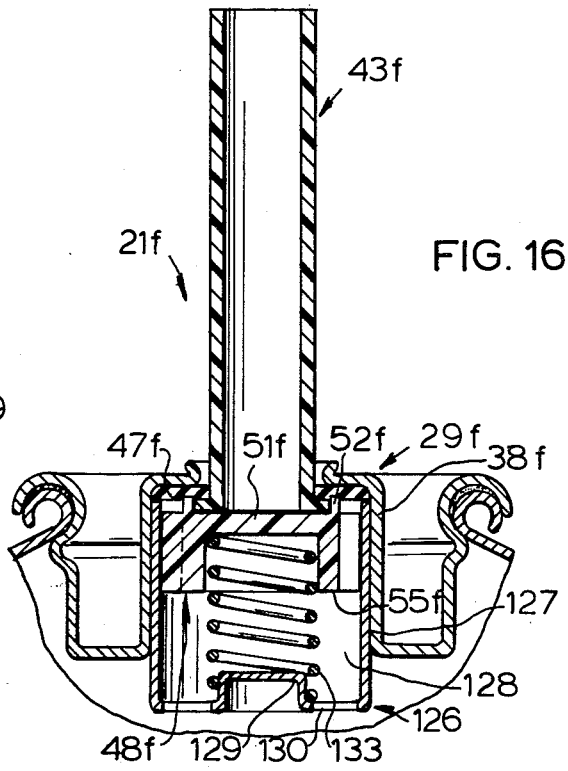
FIG. 15 is an enlarged fragmentary vertical sectional view along the axis of another embodiment of a valve structure of the present invention.
Figure 16:
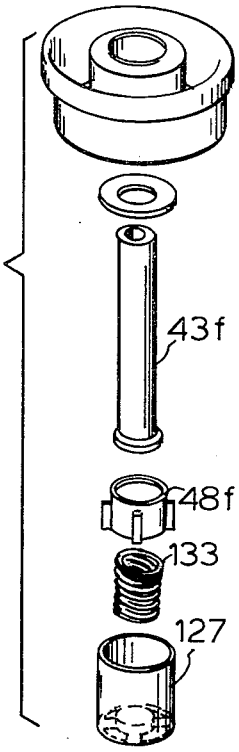
FIG. 16 is an exploded view of the valve components employed in the embodiment illustrated in FIG. 15.

Referring to FIGS. 15 and 16, there is seen another embodiment of a tilt valve structure of the present invention which is herein designated in its entirety by the numeral 21*f*; components of valve structure 21*f* which correspond to components and valve structure 21 are similarly identified but with the addition of the letter "f" thereto in each instance.

In place of the crimped portion 58 of mounting cup 29 in valve structure 21, there is here employed a bridge support means 126 which is here represented by a cup shaped embodiment that is preferably formed of sheet metal. Sidewall portions 127 of the bridge support 126 are frictionally engaged with adjacent sidewall portions of walls 38*f* of mounting cup 29*f*, thereby fixing the position of the bridge support 126 relative to the mounting cup 29*f*. Thus, the inner, cross-sectionally generally circular, wall surfaces of a central cavity 128 are identified and defined by the inner sidewalls 127. In place of a frictional engagement between the sidewalls 127 and wall member 38*f*, one can employ any convenient conventional securing means, including adhesive, or the like, if desired.

Figure 17:
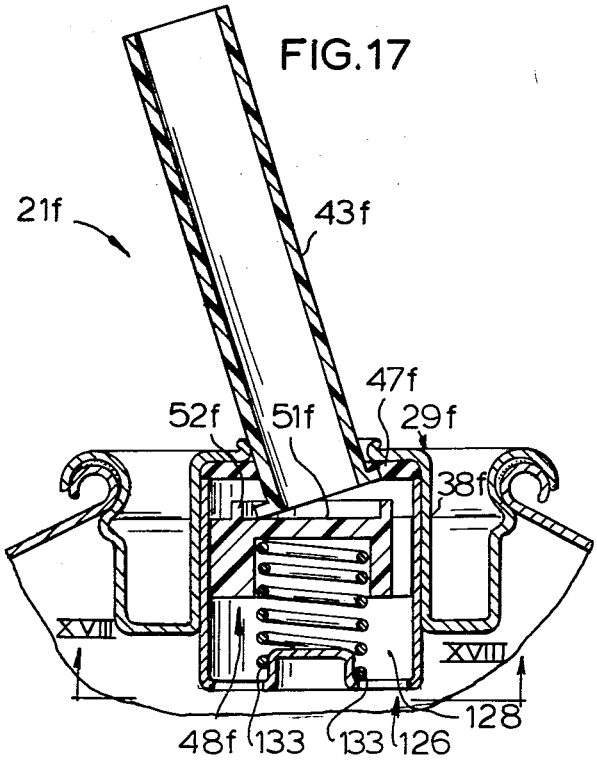
FIG. 17 is a view similar to FIG. 15, but illustrating such valve structure in an open (stem tilted) configuration.
Figure 18:
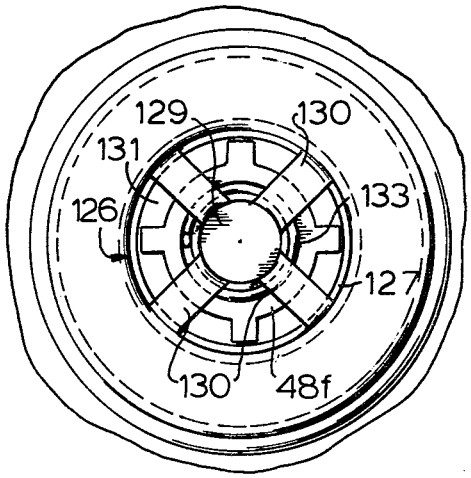
FIG. 18 is a view taken generally along the line XVIII—XVIII of FIG. 17.

The bottom or central portion 129 of the bridge support 126 is configured in the form of a spider wherein legs 130 join at their outer end portions with the sidewalls 127 and at their inner end portions with the central section 129 of the bridge support 126. The legs 130 are preferably circumferentially equally spaced from one another. The open areas 131 between circumferentially adjacent pairs of legs 130 provides apertures through which the fill contents being dispensed from a pressurized container associated with the valve structure 21*f* can pass when such valve structure is in an opened configuration. The structuring of the bridge support 126 is preferably such as to maximize the total cross-sectional area of the open areas or passageways 131 while leaving sufficient rigidity in the legs 130 to keep them spacially positioned as shown, for example, in FIG. 15 during operation of such valve structure 21*f*. The central section 129 of bridge support 126 includes a boss which is adapted to receive thereover a coiled compression spring member 133 at one end thereof; the opposed end of spring 133 is received against the valve plate 51*f* in radially adjacent relationship to the apron 55*f*. The function of the spring 133 is to yieldingly maintain the valve structure 21*f* in a normally closed configuration wherein the nozzle stem member 43*f* is in the upright configuration depicted in FIG. 15; the spring 133 thus ensures an adequate seal between the rib portion 52*f* and the gasket 47*f*. As can be seen by reference to FIG. 17, when the valve structure 21*f* is in an open configuration with the nozzle stem member 43*f* tilted, the sprinq 133 is compressed by the downward movement of the moveable cup 48*f*. The spring 133 thus introduces no impediment to the flow of viscous liquid or the like through the valve structure 21*f*.

Figure 19:
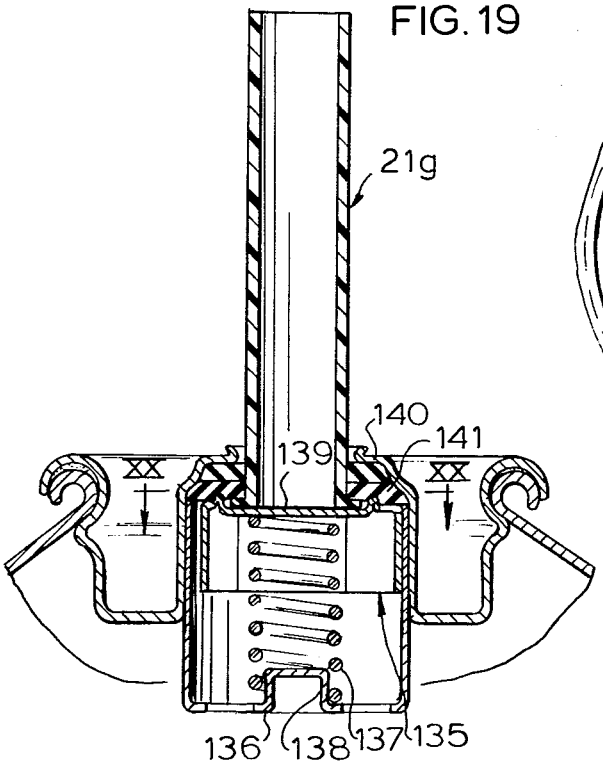
FIG. 19 is an enlarged fragmentary vertical sectional view along the axis of another embodiment of a valve structure of the present invention.
Figure 20:
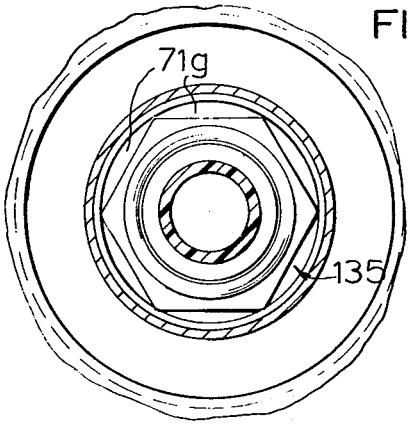
FIG. 20 is a transverse sectional view taken generally along the line XX—XX, of FIG. 19.

Referring to FIG. 19 there is seen a further embodiment of a valve structure embodiment of the present invention which is herein designated in its entirety by the numeral 21*g*. Components of valve structure 21 corresponding to components in valve structure 21*g* are similarly numbered but with the addition of the letter "g" thereto for convenience. The valve 21*g* is comparable to the valve structure 21*a* except that here the moveable cup 62 of valve structure 21*a* is replaced by an abbreviated moveable cup structure 135 wherein the step section 72 and the rear portion 64 are removed from the moveable cup member 62 to produce the moveable cup structure 135. Also, in the valve structure 21*g*, a bridge support 136 is provided which is similar in structure and function to the bridge support 126 utilized in the valve structure 21*f*. A compression spring 137 comparable to compression spring 133 is positioned over boss 138 and extends up to and against the valve plate 139 of the moveable cup structure 135. As a preference, in place of a single gasket, the twin gasket arrangement associated with the valve structure 29*e* is utilized in the present valve structure 21*g*, the two gaskets here being identified by the numerals 140 and 141, respectively, in comparison to the gaskets 120 and 121 of the valve structure 29*e*. The operation of the valve structure 21*g* is substantially identical to the operation of the valve structure previously described. The large passageways 71*g* thus are provided for the movement of viscous liquid or the like from the interior of the container 20*g* through the valve structure 21*g* in a laminar flow manner.

Figure 21:
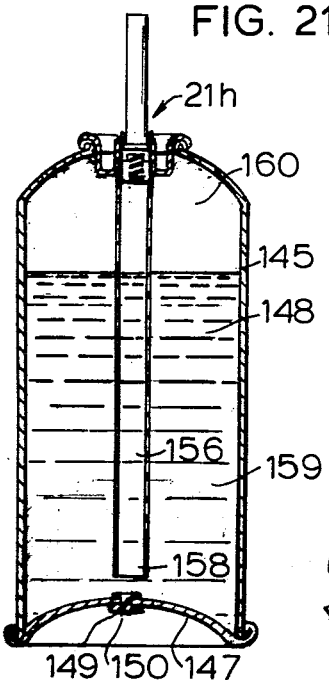
FIG. 21 is a vertical sectional view through one embodiment of a container fitted with another embodiment of a valve structure of the present invention.
Figure 22:
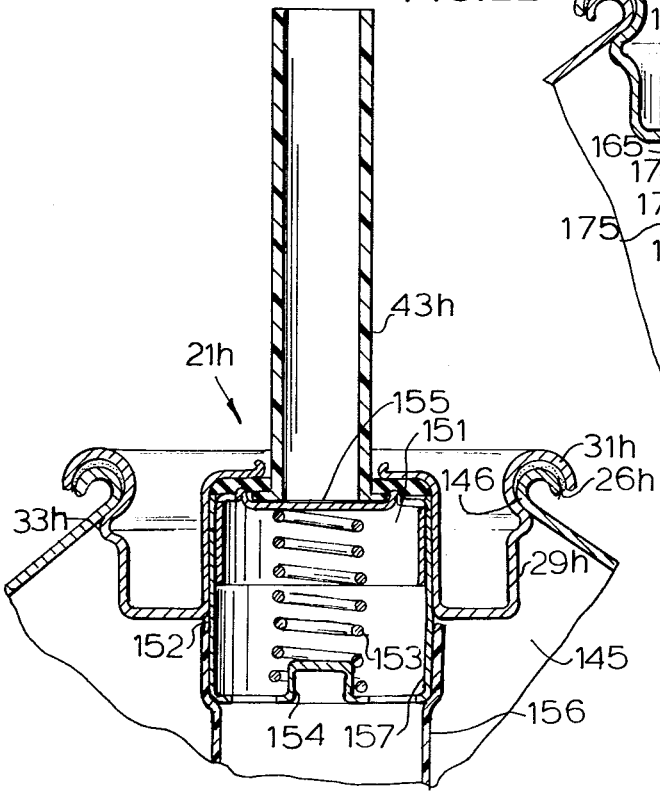
FIG. 22 is an enlarged fragmentary vertical sectional view along the axis of the valve structure shown in FIG. 21.

Referring to FIGS. 21 and 22, there is seen a dispensing container 145 which is fitted on its top end with an embodiment of a tilt valve structure of the present invention which is herein identified in its entirety by the numeral 21*h*. The container 145 is provided with an axially located aperture 146 having a rolled perimeter, the container 145 being formed in this instance of sheet metal.

The valve structure 21*h* includes a metallic mounting cup 29*h*, which terminates in a roll 31*h* that makes nesting engagement with the rolled perimeter of aperture 146. Interior surfaces of the roll 31*h* are provided with a coating 26*h* so that when the mounting cup 29*h* is fitted over the aperture 146 and formed by collet fingers or the like, there is produced a retaininq crimp 33*h*, and the preformed valve structure 21*h* is thus sealingly associated with the container 145.

Container 145 is provided with a domed bottom cap 147 formed of metal or the like which is press formed onto the bottom end of the container 145.

With the valve structure 21*h* and the cap 147 thus mounted to the container 145, the interior of the vessel 145 defines a chamber 148. Access to the interior of chamber 148 may be obtained if desired through the cap 147 which is provided with a centrally disposed aperture 149 that is sealingly closable by a plug 150. Chamber 148 is filled in a conventional manner with material to be dispensed and a pressurizing substance, such as a fluorocarbon or the like. By employing as the pressurizing substance a low boiling liquid at ambient temperatures, as material is dispensed from chamber 48 through valve structure 21*h*, the pressure in the chamber 148 is maintainable substantially at a constant value by regulating the quantity of pressurizing substance initially charged into the chamber 48, as those skilled in the art will appreciate.

The structure of the valve 21*h* may be regarded as being similar to the structure of valve 21*b* except that in the present embodiment, in place of the moveable cup member 78, there is employed a moveable cup member 151 which is similar to upper portion 79 of moveable cup member 78, but with the rear portion 80 and also the step portion 81 removed therefrom. In addition, in place of crimped portion 58, a bridge support 152 is utilized which is similar in structure and function to the bridge support 136 of valve structure 21*g*. A compression spring 153 is disposed between boss 154 of bridge support 152 and the valve plate 155 of moveable cup member 151. The operation of valve structure 21*h* is similar to that for the valve structures of this invention previously described.

The valve structure **21*h* is additionally provided with a dip tube 156 which is frictionally secured at the dispensing end thereof to the sidewalls 157 of the bridge support 152. The dip tube 156 is construed of a flexible plastic material, preferably, and the lower end 158 of dip tube 156 is adapted to be below the level of a liquid phase, such as liquid phase 159 in container 145. Thus, the dip tube 156 ensures that when the stem member 43*h* is tilted, liquid will be dispensed through the valve structure 21*h* rather than the pressurizing gas from a gas phase, such as gas phase 160, in the container 145**. Thus, a valve structure of the present invention may be used, if desired, with a dip tube.

Figure 23:
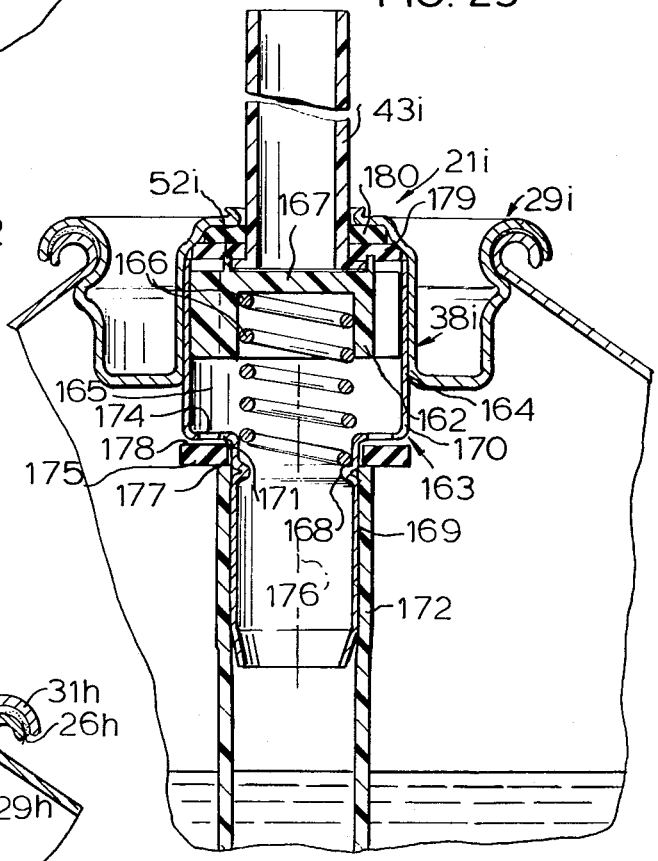
FIG. 23 yet another embodiment of a tilt valve structure of the present invention shown in enlarged fragmentary vertical section.

Referring to FIG. 23, there is seen another embodiment of a valve structure of the present invention herein designated in its entirety by the numeral **21*i*. Components in the valve structure 21*i* which are similar to the components employed in the valve structure 21 are similarly numbered but with the addition of the letter "i" thereto. The valve structure 21*i* utilizes a moveable cup member 161 which is similar in structure and function to the previously described moveable cup members 48 and 48*f*. In place of bridge support means 126, there is employed a retaining cup member 163 whose sidewalls 164 are frictionally fixedly engaged with the sidewalls 38*i* of mounting cup 29*i* and whose sidewalls 164 form the inner wall surfaces of a generallly cross-sectionally circular chamber 165 within which the moveable cup member 162 slidably reciprocates during valve structure 21*i*** operation.

A compression spring 166 extends from the interior bottom phase of valve plate 167 of moveable cup member 162 axially downwardly (away from the nozzle stem member **43*i*) to a position where the spring 166 rests against a circumferentially extending crimped portion 168 formed in the retaining cup member 163. The crimped portion 168 exists in a rear portion 169 of the retaining cup member 163 which is separated from the upper portion 170 thereof by a step portion 171. Conveniently, the retaining cup member 163 is formed of sheet metal or the like. Extending below the crimped portion 168 and circumferentially about the rear portion 169 is mounted a dip tube 172 which dip tube 172 is conveniently formed of a flexible plastic or the like, as those skilled in the art will appreciate. Thus, there is a secure frictional engagement between the rear portion 169 and adjacent portions of the dip tube 172**.

Defined in the step portion 171, as by perforation or the like, are a plurality of apertures 174 which are conveniently equally circumferentially spaced from one another and which are conveniently substantially identically sized relative to one another. Circumferentially around the upper neck of rear portion 169 is positioned a gasket 175 which has a limited slidable movement relative to the axis 176 of the valve structure **21*i* between the upper end 177 of the dip tube 172 and the exterior phase of the step portion 171. When the valve structure 21*i* is in the normally closed configuration as shown in FIG. 23, the gasket 175 is in the position illustrated in FIG. 23. Thus, there is a small gap 178 between the exterior phase of step portion 171 and the adjacent phase of gasket 175. Through this gap 175 fluid material can escape from chamber 165 at termination of a valve dispensing operation and fluid which drains from chamber 165 passes down over the edge of gasket 175** back in to the main liquid well or reservoir within the associated container (not detailed).

As soon as the valve **21*i* is in an open configuration with the nozzle stem member 43*i* in a tilted configuration (not shown), the gasket 175 slidably moves upwardly against the exterior phase of step portion 171, in effect sealing the apertures 174. The gasket 175 moves into such a valve closing relationship relative to the apertures 174 by reason of a pressure differential existing between the interior of the container on the one hand as opposed to the reduced pressure existing in valve opening operations within the chamber 165. The closing of the gasket 175 against apertures 174 is desirable in order to prevent gas from escaping through the apertures 174 and thereby venting to the atmosphere through the nozzle stem member 43*i*. When the valve is in a closed configuration, it is desirable to have the liquid material drained from the chamber 165 in order to obtain a good seal between the rib portions 52*i* and the sealing gasket 179. It is also desired to have a gas pressure within the container serve as an aid to effectuating and to maintaining the desired complete sealing action between the rib portion 52*i* and the gasket 179. The gasket 180 serves a function identical to both the gasket 140 previously described in relation to valve structure 21*g* and the gasket 120 previously described in relation to the valve structure 43*e***.

Although the teachings of my invention have herein been discussed with reference to specific embodiments, it is to be understood that these are by way of illustration only and that others may wish to utilize my invention in different designs or applications.

I claim:

1. A fluid dispensing valve structure for dispensing the viscous contents of a pressurized container comprising:

a valve mounting cup member peripherally sealingly securable to said pressurized container and having generally continuous walls with a central aperture defined therein, said continuous walls defining an interior valve receiving chamber adjacent to said central aperture, a resilient seal member carried within said mounting cup member radially adjacent said central aperture, an elongated tubular nozzle means having a dispensing orifice in one end thereof and having a second opposed and outwardly flanged end extending through said central aperture and supported in said mounting cup member by said resilient seal member in a normally generally straight upright extended position, a moveable valve cup member longitudinally reciprocally slidably carried within said valve receiving chamber adjacent side portions thereof and normally biasable against said resilient seal member to form a seal means for normally sealing the contents of said container, said moveable valve cup member being engageable with said second end, said contents of said pressurized container being dispensable when said one end is tiltably displaced relative to said generally straight upright extended position by an external deflecting operating force applied thereagainst, thereby opening said seal means, said moveable valve cup member including:

(A) a base portion extending across said second end of said tubular nozzle means, (B) annular rib means upstanding from said base portion for engaging said resilient seal member peripherally of said tubular nozzle means, (C) guidance means for orienting said moveable valve cup member relative to said valve receiving chamber for stable reciprocal sliding movements of said moveable valve cup member longitudinally along said continuous walls, (D) channel means defined by said moveable valve cup member and longitudinally extending therethrough and terminating peripherally of said annular rib means and adapted for the laminar flow of a viscous fluid therethrough, said channel means having an effective cross-sectional area therealong which is at least equal to the effective cross-sectional area of said tubular nozzle means, the interrelationship between said moveable valve cup member, said tubular nozzle means, said resilient seal member, and said valve mounting cup member being such that a substantially unobstructive and non-turbulent flow of said contents through said valve structure can occur when said one end is so tiltably displaced.

2. The fluid dispensing valve structure of claim 1 wherein said guidance means comprises a plurality of integral second rib means radially outwardly extending from said base portion for slidably reciprocally guiding said moveable valve cup member relative to said valve mounting cup member, and wherein circumferentially adjacent pairs of said second rib means define therebetween said channel means.

3. The fluid dispensing valve structure of claim 1 wherein said guidance means comprises integral means defining a continuous guiding surface on longitudinal portions of said moveable cup member which sidewall means are adjacent to said continuous walls and are longitudinally reciprocally slidable relative thereto, and an integral step portion is located between and interconnects said rib means with said sidewall means, said step portion having a plurality of apertures defined therethrough.

4. The valve structure of claim 3, additionally including retaining means which limits extent of such slidability of said moveable valve cup member relative to said mounting cup member away from said resilient seal member and which retains said valve structure in an assembled configuration.

5. The valve structure of claim 3, so secured to said pressurized container and wherein said pressurized contents provide yielding biasing means urging formation of said seal means.

6. The valve structure of claim 2, additionally including retaining means which limits extent of such slidability of said moveable valve cup member relative to said mounting cup member away from said resilient seal member and which retains said valve structure in an assembled configuration.

7. The valve structure of claim 2, so secured to said pressurized container and wherein said pressurized contents provide yielding biasing means urging formation of said seal means.

8. The fluid dispensing valve structure of claim 2 wherein said moveable valve cup member is cross-sectionally generally polygonally configured and wherein individual ones of said second rib means are each defined by a different corner, each corner being formed by the junctions of two adjacent polyol sides, and wherein individual ones of said channel means are each defined adjacently to a different said polygon side.

9. The valve structure of claim 2, wherein said plurality of second rib means extends from said base portion longitudinally away from said resilient seal member along said moveable valve cup member to a distance at least sufficient to avoid any appreciable cocking of said moveable valve cup member relative to said mounting cup member,

10. The valve structure of claim 9, wherein said moveable cup member further includes integral support means longitudinally extending from said base portion for rigidifying said plurality of second rib means.

11. The valve structure of claim 10, wherein said support means comprises a continuous circumferentially extending apron interconnected to said base portion and to interior ends of each of said plurality of second rib means.

12. The valve structure of claim 10, wherein said support means comprises the interconnected radially interior ends of each of said plurality of second rib means.

13. An improved moveable valve cup member for a fluid dispensing valve structure of the type having a mounting cup member, a resilient seal member, an elongated tubular nozzle means having an outer and inner end, and a moveable valve cup member, said valve structure being adapted to dispense therethrough the viscous contents of a pressurized container with which said valve structure is functionally associated, said contents being so dispensable through said valve structure when said nozzle is tilted relative to said mounting cup member from a normally upright position to open a normally closed seal between said seal member and said moveable valve cup member, said moveable valve cup member comprising:

(A) an integral base portion extending across said inner end of said tubular nozzle means, (B) an integral rib means annularly upstanding generally from said base portion for engaging said resilient seal member peripherally of said inner end of said tubular nozzle means to form said seal means when said tubular nozzle means is in said upright position, (C) integral means defining a continuous guiding surface on longitudinal portions of said moveable cup member which said longitudinal portions are adjacent to said mounting cup member and are longitudinally reciprocally slidable relative thereto, and (D) an integral step portion located between and interconnecting said rib means with said guiding surface means, said step portion having a plurality of apertures defined therethrough, the interrelationship in said valve structure with said movable valve between said moveable valve cup member, said tubular nozzle means; said resilient seal member, said mounting cup member and said apertures being such that a substantially unobstructed flow of said contents through said moveable valve cup member structure can occur when said moveable valve cup member is operably associated with such fluid dispensing valve structure, said apertures having an effective cross-sectional area therealong which is at least equal to the effective cross-sectional area of said tubular nozzle means.

14. A device for dispensing a highly viscous liquid comprising:

(A) a pressurizable container, (B) a fluid dispensing valve structure functionally secured to said container and having fluid communication with the interior thereof, and (C) said valve structure comprising in combination: a valve mounting cup member peripherally sealingly securable to said pressurized container and having generally continuous walls with a central aperture defined therein, said continuous walls defining an interior valve receiving chamber adjacent to said central aperture, a resilient seal member carried within said mounting cup member radially adjacent said central aperture, an elongated tubular nozzle means having a dispensing orifice in one end thereof and having a second opposed inner end extending through said central aperture and supported in said mounting cup member by said resilient seal member in a normally generally straight upright extended position, a moveable valve cup member longitudinally reciprocally slidably carried within said valve receiving chamber and normally biasable against said resilient seal member to form a seal means for normally sealing the contents of said container, said moveable valve cup member being engageable with said second end, said contents of said pressurized container being dispensable when said one end is tiltably displaced relative to said generally straight upright extended position by an external deflecting operative force applied thereagainst, thereby opening said seal means, said moveable valve cup member comprising:

(a) a base portion extending across said second end of said tubular nozzle means, (b) annular rib means upstanding from said base portion for engaging said resilient seal member peripherally of said tubular nozzle means, (c) guidance means for orienting said moveable valve cup member relative to said valve receiving chamber for stable reciprocal sliding movement of said moveable valve cup member longitudinally along said continuous walls relative to said mounting cup, (d) channel means defined in said moveable valve cup member longitudinally extending therethrough and terminating peripherally of said annular rib means and adapted for the laminar flow of a viscous fluid therethrough, said channel means having an effective cross-sectional area therealong which is at least equal to the effective cross-sectional area of said tubular nozzle means, the interrelationship between said moveable valve cup member, said tubular nozzle means, said resilient seal member, and said mounting cup member being such that a substantially unobstructed and non-turbulent flow of said contents through said valve structure can occur when said one end is so tiltably displaced.

15. The device of claim 14, wherein said moveable valve cup member comprises:

(a) an integral base portion, (b) an integral first rib means, (c) a plurality of integral second rib means radially outwardly extending from said base portion beyond said first rib means for slidably reciprocally guiding said moveable valve cup member relative to said valve mounting cup member, and circumferentially adjacent pairs of said second rib means defining therebetween said channel means for the movement therethrough of said contents when said moveable valve cup member is operably associated with such valve structure and said seal means is open.

16. The device of claim 14, wherein said moveable valve cup member comprises:

(A) an integral base portion, (B) an integral rib means, (C) integral sidewall means defining a continous guiding surface on longitudinal portions of said moveable cup member which are adjacent to said continuous walls and are longitudinally reciprocally slidable relative thereto, and (D) an integral step portion located between and interconnecting said rib means with said sidewall means, said step portion having a plurality of apertures defined therethrough.

17. A fluid dispensing valve structure for dispensing the viscous contents of a pressurized container comprising:

a valve mounting cup member peripherally sealingly securable to said pressurized container and having generally continuous walls with a central aperture defined therein, said continuous walls defining an interior valve receiving chamber adjacent to said central aperture, said valve receiving chamber having an open bottom portion in opposed relationshp to said central aperture, a resilient seal member carried within said mounting cup member radially, adjacent said central aperture, a sealing membrane extending across said bottom portion and bonding means mounting peripheral portions of said sealing membrane to said continuous walls, an elongated tubular nozzle means having a dispensing orifice in one end thereof and having a second opposed inner end extending through said mounting cup member and supported in said mounting cup member by said resilient seal member in a normally generally straight upright extended position, a moveable valve cup member longitudinally reciprocally slidably carried within said valve receiving chamber and normally biasable against said resilient seal member to form a seal means for normally sealing the contents of said container, said moveable valve cup member being engageable with said second end, said contents of said pressurized container being dispensable when said one end is tiltably displaced relative to said generally straight upright extended position by an external deflecting operating force applied thereagainst, thereby opening said seal means, said moveable valve cup member including:

(A) a base portion extending across said moveable valve cup member relative to said mounting cup member for stable reciprocal sliding movements longitudinally relative to said mounting cup member, (B) annular rib means upstanding from said base portion for engaging said resilient seal member peripherally of said tubular nozzle means, (C) guidance means for orienting said moveable valve cup member relative to said valve receiving chamber for stable reciprocal sliding movement of said moveable valve cup members longitudinally along said continuous walls, (D) channel means defined in said moveable valve cup member longitudinally extending therethrough and terminating peripherally of said annular rib means and adapted for the laminar flow of a viscous fluid therethrough, said channel means having an effective cross-sectional area therealong which is at least equal to the effective cross-sectional area of said tubular nozzle means, and (E) cutting edge means downwardly extending from said base portion for rupturing said sealing membrane when said moveable cup member is initially downwardly so slidably moved thereagainst by tilting of said tubular nozzle means, the interrelationship between said moveable cup member, said tubular nozzle means, said resilient seal member, said mounting cup member and said sealing membrane when such is so ruptured being such that a substantially unobstructed and non-turbulent flow of said contents through said valve structure can occur when said one end is so tiltably displaced.

18. The valve structure of claim 17, wherein said guidance means and said channel means are provided by a plurality of integral second rib means radially outwardly extending from said base portion beyond said first rib means for slidably reciprocally guiding said moveable valve cup member relative to said cup member, and circumferentially adjacent pairs of said second rib means defining therebetween channel means for the movement therethrough of said contents when said one end is so tiltably displaced.

19. The valve structure of claim 17, wherein said guidance means is defined by integral means defining a continuous guiding surface on longitudinal portions of said moveable cup member which said longitudinal portions are adjacent to said mounting cup member and are longitudinally so reciprocally slidable relative thereto, and said channel means is defined by a plurality of apertures defined in an integral step portion located between and interconnecting said rib means with said guiding surface.

20. The valve structure of claim 17, additionally including retaining means which limits extent of such slidability of said moveable valve cup member relative to said mounting cup member away from said resilient seal member and which retains said valve structure in an assembled configuration.

21. A fluid dispensing valve structure for dispensing the viscous contents of a pressurized container comprising:

a valve mounting cup member peripherally sealingly securable to said pressurized container and having generally continuous walls with a central aperture defined therein, said continuous walls defining an interior valve receiving chamber adjacent to said central aperture, a resilient seal member carried within said mounting cup member radially adjacent said central aperture, an elongated tubular nozzle means having a dispensing orifice in one end thereof and having a second opposed and outwardly flanged end extending through said central aperture and supported in said mounting cup member by said resilient seal member in a normally generally straight upright extended position, a moveable valve cup member longitudinally reciprocally slidably carried within said valve receiving chamber adjacent side portions thereof and normally biasable against said resilient seal member to form a seal means for normally sealing the contents of said container, said moveable valve cup member being engageable with said second end, said contents of said pressurized container being dispensable when said one end is tiltably displaced relative to said generally straight upright extended position by an external deflecting operating force applied thereagainst, thereby opening said seal means, said moveable valve cup member including:

(A) a base portion extending across said second end of said tubular nozzle means, (B) annular first rib means upstanding from said base portion for engaging said resilient seal member peripherally of said tubular nozzle means to form said seal means when said tubular nozzle means is in said upright position, (C) a plurality of integral second rib means radially outwardly extending from said base portion for slidably reciprocally guiding said moveable valve cup member relative to said valve mounting cup member, and wherein circumferentially adjacent pairs of said second rib means define therebetween in combination with adjacent portions of said continuous walls channel means for the movement therethrough of said contents when said one end is so tiltably displaced, said channel means having an effective cross-sectional area therealong which is at least equal to the effective cross-sectional area of said tubular nozzle means, bridge support means which includes fastening means mounting said bridge support means to said valve mounting cup member and which includes an integrally formed and centrally disposed spider said spider having a plurality of generally radially extending integral joining members center connecting an integral mid portion with integral peripheral portions of said bridged support means, circumferentially adjacent pairs of said joining members defining therebetween relatively large passageways for the movement therethrough of said contents when said one end is so tiltably displaced, the interrelationship between said moveable valve cup member, said tubular nozzle means, said resilient seal member, said mounting cup member, and said bridge support means being such that a substantially unobstructed and non-turbulent flow of said contents through said valve structure can occur when said one end is so tiltably displaced.

22. The valve structure of claim 21, wherein said moveable cup member includes an integral foot means centrally located and extending in a direction opposed to said resilient seal member and further extending through a guidance aperture defined in said mid portion, said foot means being adapted for reciprocal sliding movements relative to said guidance aperture during such reciprocal sliding movements of said moveable cup member, thereby to stabilize the orientation of said moveable valve cup member relative to said mounting cup member.

23. The valve structure of claim 21, wherein said mid portion has a boss defined therein which is adapted to position a compression spring means urging formation of said seal means and extending between said boss and said moveable cup member.

24. The valve structure of claim 21 wherein said fastening means consists of an interference fit between said continuous walls and peripheral portions of said bridge support means.

* * * * *